US006675894B2

(12) United States Patent
Vick, Jr. et al.

(10) Patent No.: US 6,675,894 B2
(45) Date of Patent: Jan. 13, 2004

(54) METAL TO METAL SEAL FOR USE IN WELL PLUGGING APPLICATIONS, AND ASSOCIATED METHODS

(75) Inventors: James D. Vick, Jr., Dallas, TX (US); Robert Guyden, Parker, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/041,278

(22) Filed: Jan. 8, 2002

(65) Prior Publication Data

US 2003/0127224 A1 Jul. 10, 2003

(51) Int. Cl.[7] ..... E21B 33/13

(52) U.S. Cl. ..... 166/285; 166/135; 166/192; 166/386

(58) Field of Search ..... 166/285, 386, 166/75.13, 135, 192; 277/314, 343, 322; 138/89

(56) References Cited

U.S. PATENT DOCUMENTS 2,106,996 A * 2/1938 Edwards ..... 138/89

4,831,703 A * 5/1989 Wilhelm et al. ..... 138/89

OTHER PUBLICATIONS

Cefilac Etancheite catalog, "helicoflex High Performance Sealing," undated.

SSR catalog, "SSR Horizontal Tree Isolation Plug", "Upper Isolation Plug c/w Metal Seal", "Lower Isolation Plug c/w Erosion Target", undated.

Sierracin/Harrison catalog, "Metal Static Seals", undated.

* cited by examiner

*Primary Examiner*—David Bagnell
*Assistant Examiner*—Matthew J Smith
(74) *Attorney, Agent, or Firm*—Marlin R. Smith; J. Richard Konneker

(57) ABSTRACT

A plug is provided for use in well plugging applications. In a described embodiment, the plug has a metal to metal seal on a hollow spherical structure. A change in contact pressure between the seal and a bore due to a change in differential pressure across the plug is regulated by changing characteristics of the plug structure.

66 Claims, 6 Drawing Sheets

METAL TO METAL SEAL FOR USE IN WELL PLUGGING APPLICATIONS, AND ASSOCIATED METHODS

BACKGROUND

The present invention relates generally to equipment and methods utilized in conjunction with subterranean wells and, in an embodiment described herein, more particularly provides a metal to metal seal.

Wellhead plugs which utilize metal to metal seals are well known in the art. The metal to metal seals are typically secured in wellheads using anchoring devices, with the seals being installed in seal bores of the wellheads. Typically, the seals are only effective in sealing against pressure differentials applied in one direction, for example, from below the wellhead.

However, there are many circumstances in which it would be desirable for a metal to metal seal to be able to seal against pressure differentials applied alternately from above and below the wellhead. For example, it may be desired to perform a pressure test in a riser above the wellhead, in which case the wellhead plug should be capable of containing the pressure in the riser above the wellhead. Of course, there are many other circumstances in which a bidirectional metal to metal seal would be desirable.

Another limitation of current metal to metal seals is that they are unable to satisfactorily regulate contact pressures between the seals and the bores against which they seal. In a typical metal to metal seal, an increase in pressure differential applied from one axial direction tends to expand the seal and increase the contact pressure at a rate which quickly leads to yielding of the seal and/or bore material. The seal may be made more rigid to limit the rate of contact pressure increase, but this solution causes other problems, such as requiring the use of exceptionally tight machining tolerances, etc.

Yet another problem occurs with metal to metal seals which are installed in grooves. Such a seal presents at least two leak paths. One leak path is between the seal and the bore, and the other leak path is between the seal and the groove.

SUMMARY

In carrying out the principles of the present invention, in accordance with an embodiment thereof, a plug is provided which utilizes a metal to metal seal for well plugging applications. Associated methods are also provided.

In one aspect of the invention, a plugging system is provided which includes a metal seal circumferentially contacting a bore and a piston attached to the seal. The piston biases the seal in the direction of a pressure differential applied across the piston.

When the pressure differential is applied in one axial direction, tensile axial stress is applied to the seal by the piston. This tensile stress may act to radially inwardly bias the seal. The pressure differential may also act to radially outwardly bias the seal due to circumferential tensile stress. The stresses in the seal may be adjusted by appropriately configuring the plug structure, so that a desired contact pressure is achieved when a particular pressure differential is applied in the axial direction.

When the pressure differential is applied in an opposite axial direction, compressive axial stress is applied to the seal by the piston. This compressive stress may act to radially outwardly bias the seal. The pressure differential may also act to radially inwardly bias the seal due to circumferential compressive stress. The stresses in the seal may be adjusted by appropriately configuring the plug structure, so that a desired contact pressure is achieved when a particular pressure differential is applied in the opposite axial direction.

In another aspect of the invention, radially inwardly and outwardly biasing of the seal may be regulated or limited by the piston portion of the plug. For example, an increased rigidity of the piston will better Emit the inwardly and outwardly biasing of the seal.

In still another aspect of the invention, the plug may include a substantially hollow spherical structure having opposite open and closed ends, with the seal being positioned between the ends. The open end admits pressure into the interior of the structure, and the closed end prevents pressure transmission therethrough. The seal is disposed on a circumferentially continuous portion of the structure between the ends.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
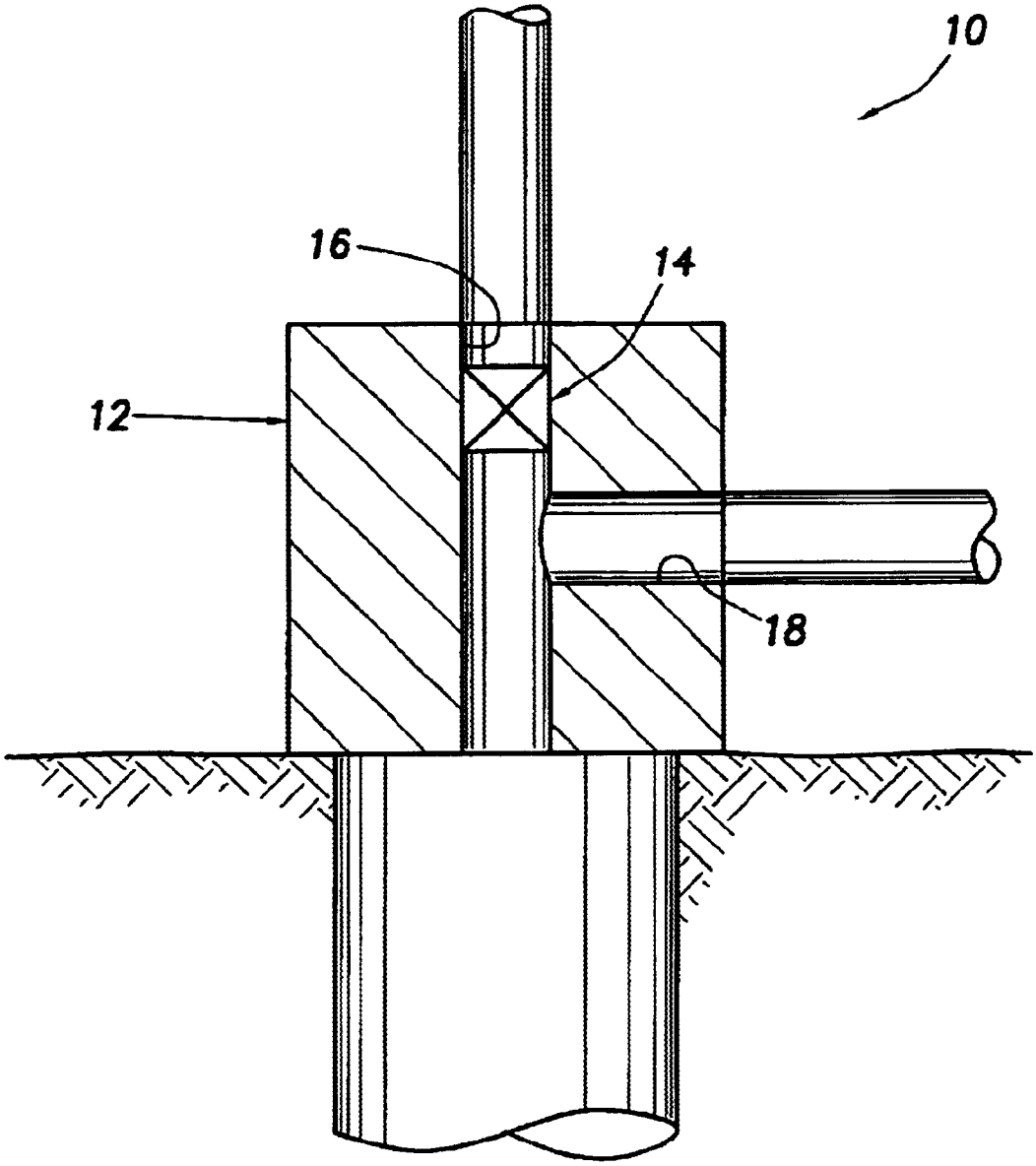
FIG. 1 is a schematic view of a plugging system embodying principles of the present invention.

Representatively illustrated in FIG. 1 is a wellhead plugging system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the embodiments of the present invention described herein may be utilized in various orientations, such as inclined, inverted, horizontal, vertical, etc., and in various configurations, without departing from the principles of the present invention.

The system 10 as depicted in FIG. 1 includes a wellhead 12 having a wellhead plug 14 installed therein. In this embodiment, the plug 14 is installed in a bore 16 extending vertically through the wellhead 12. However, the plug 14 could also be used in other types of bores, such as a horizontal bore 18 intersecting the vertical bore 16, a bore in the well below the wellhead 12, etc.

Figure 8:
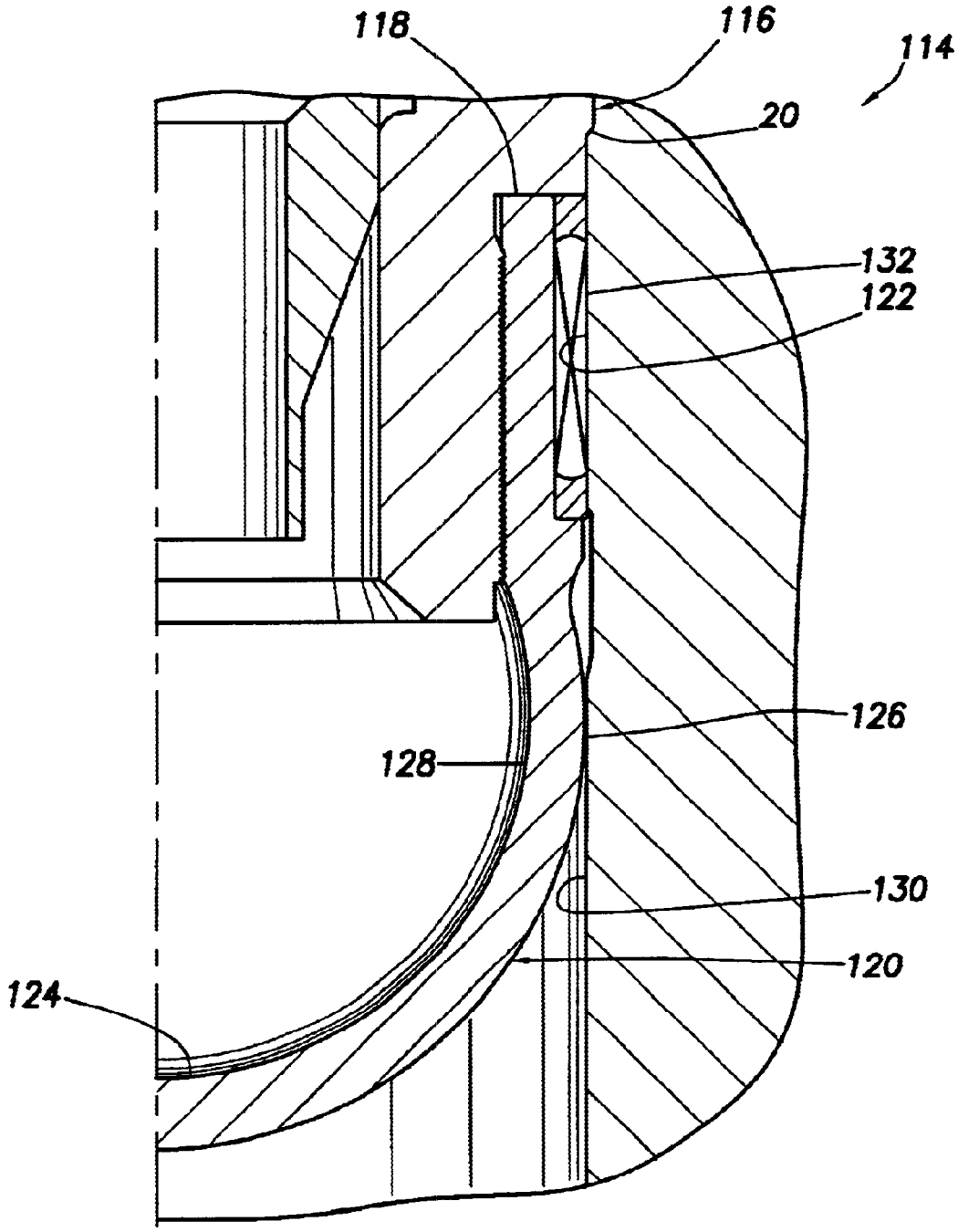
FIG. 8 is a cross-sectional view of a second metal to metal seal embodying principles of the present invention.

To install the plug 14, the plug is lowered into the bore 16 until it rests on a relatively small no-go shoulder 20 (not visible in FIG. 1, see FIG. 8). The plug 14 is then set in the wellhead 12 using a running tool (not shown) of the type well known to those skilled in the art.

Preferably, the plug 14 seals against the bore 16 utilizing a metal to metal seal, thereby blocking fluid flow through the bore and resisting pressure differentials across the plug. Various embodiments of plugs having metal to metal seals are described below, and each of these may be utilized in the plugging system 10 or other plugging systems embodying principles of the present invention.

Figure 2:
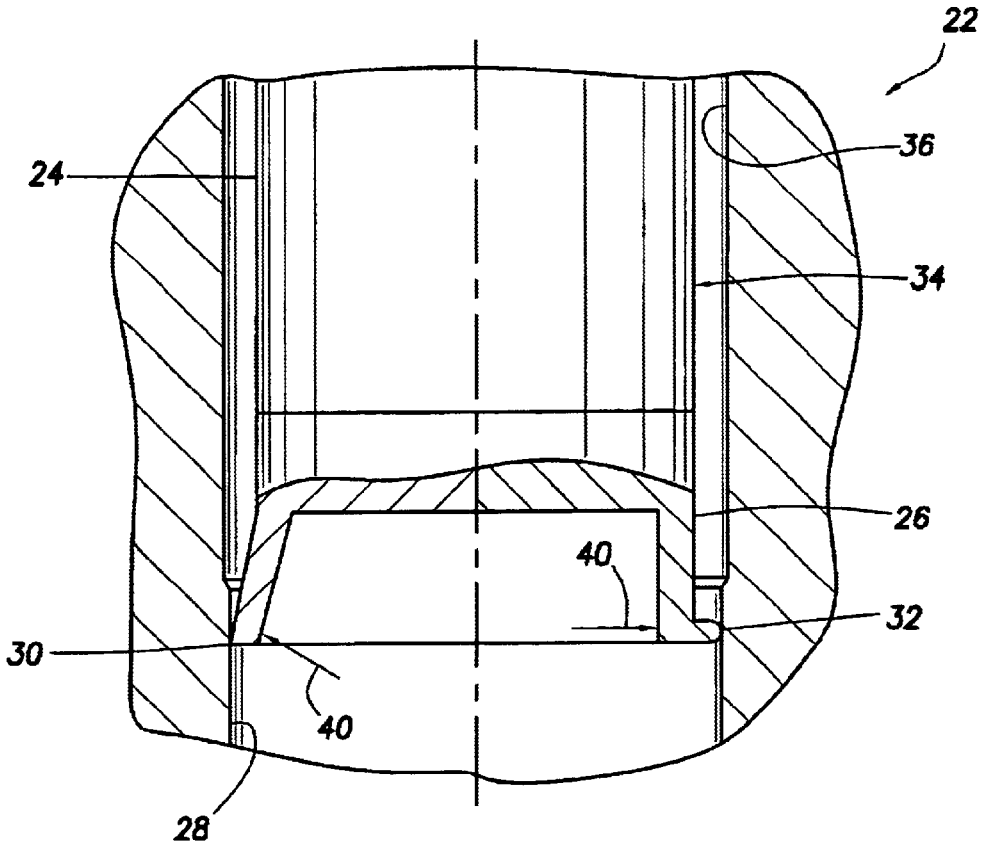
FIG.2 (PRIOR ART)
FIG. 2 is a partially cross-sectional view of a prior art metal to metal seal.
Figure 3:
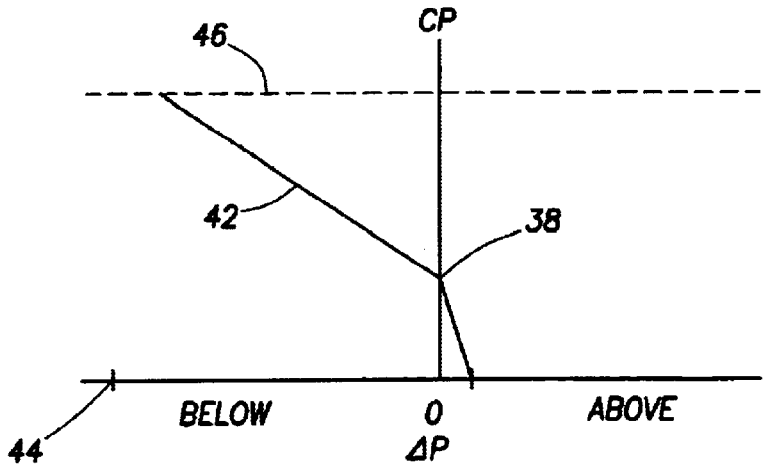
FIG.3 (PRIOR ART)
FIG. 3 is a plot of contact pressure vs. differential pressure for the metal to metal seal of FIG. 2.

Turning now to FIGS. 2 & 3, a prior art plugging system 22 is illustrated, so that advantages of the present invention over prior art plugging systems may be clearly understood. The system 22 includes a plug 34 having an anchoring device 24 attached to a metal to metal seal 26. The seal 26 may be cone-shaped as shown on the left-hand side of FIG. 2, in which case a major outer diameter 30 of the cone may contact a seal bore 28, or the seal may be cylindrical as shown on the right-hand side of FIG. 2, in which case a lip or nose 32 formed on the seal may contact the seal bore.

The plug 34 is lowered into a bore 36 until the seal 26 engages the seal bore 28. Since the seal bore 28 is smaller in diameter than either the major diameter 30 or the lip 32, the seal 26 must be radially compressed somewhat in order for the seal to completely enter the seal bore. This compression of the seal 26 radially inward produces an initial contact pressure between the seal and the bore 28.

On the FIG. 3 plot, this initial contact pressure is shown as point 38. Contact pressure is represented by the vertical axis on the plot, and differential pressure is represented by the horizontal axis. Differential pressure from below is indicated by the horizontal axis to the left of the vertical axis, and differential pressure from above is indicated by the horizontal axis to the right of the vertical axis. Thus, with no differential pressure across the seal 26, the initial contact pressure 38 exists due only to installation of the seal in the bore 28.

Some initial contact pressure is desirable to prevent leakage past the seal 26 at very low pressure differentials. However, it will be readily appreciated by those skilled in the art that the initial contact pressure 38 of the system 22 is highly dependent upon the radial interference between the seal 26 and the bore 28. For this reason (and others discussed below), the radial interference in situations such as these is typically in the range of 0.001–0.002 in., with tolerances of only about 0.00025 in. being permitted. This requires the use of highly accurate and expensive machining techniques, such as precision grinding, to achieve the required dimensions of the seal 26 and bore 28.

When a pressure differential from below is applied to the seal 26, it is biased radially outward at its lower end, urging either the major diameter 30 or the lip 32 against the bore 28. This outward biasing is indicated by arrows 40 in FIG. 2. As the pressure differential from below increases, the contact pressure between the seal and the bore 28 also increases.

The increase in contact pressure due to increased pressure differential from below the seal 26 is indicated by the sloped line 42 in FIG. 3. It may be readily seen that the contact pressure rapidly increases as the differential pressure from below increases.

While some increase in contact pressure due to increased differential pressure may be desirable in some cases (such as, when the initial contact pressure 38 is not sufficient to seal against the increased differential pressure), a too rapid increase in contact pressure can cause problems. For example, if a required differential pressure rating for a particular application (indicated at point 44 on the horizontal axis of FIG. 3) would cause a contact pressure greater than a yield strength of the seal or bore 28 (indicated by horizontal line 46 on FIG. 3), the seal 26 cannot be used at that differential pressure, for to do so would cause permanent damage to the seal or bore.

Another problem with the seal 26 is that it effectively seals against differential pressure in only one direction (from below). As shown on the right-hand side of the plot in FIG. 3, the contact pressure quickly drops when differential pressure is applied from above, thereby enabling the seal 26 to leak. This is due to the fact that the seal 26 is biased radially inward when a pressure differential is applied from above, rapidly reducing the contact pressure between the seal and the bore 28.

Attempts may be made to remedy these problems with the seal 26. For example, the wall thickness of the seal 26 may be made thicker to reduce the rate at which the contact pressure increases with increased pressure differential from below. Unfortunately, however, this results in an increased initial contact pressure 38, which is closer to the yield strength limit 46 of the seal 26 or bore 28, which in turn leaves less room available for increased contact pressure due to increased differential pressure. Furthermore, the thicker wall thickness will still not make the seal 26 effective at sealing against any significant differential pressure from above.

In contrast, the present inventors have developed a way to regulate contact pressure between a seal and a bore, so that within a required range of pressure differentials applied across the seal, the contact pressure remains below an upper desired limit and remains above a desired lower limit. For example, the upper desired limit may be a yield strength of the seal or bore material (or acceptable fraction thereof), and the lower limit may be a contact pressure needed to seal against any given pressure differential within the required range. The solution presented by the inventors is far more useful than prior systems, and is much more economical to produce.

Figure 4:
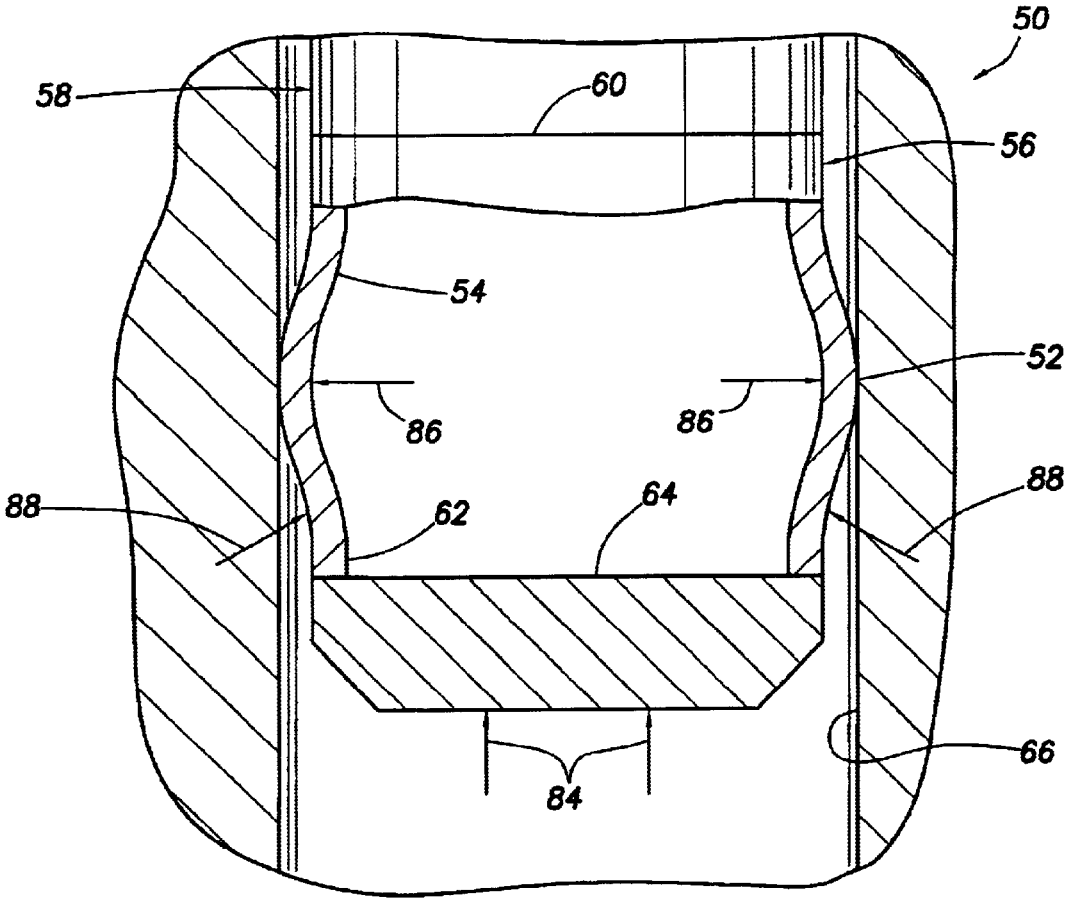
FIG. 4 is a cross-sectional view of a first metal to metal seal embodying principles of the present invention, a differential pressure from below being applied to the seal.
Figure 5:
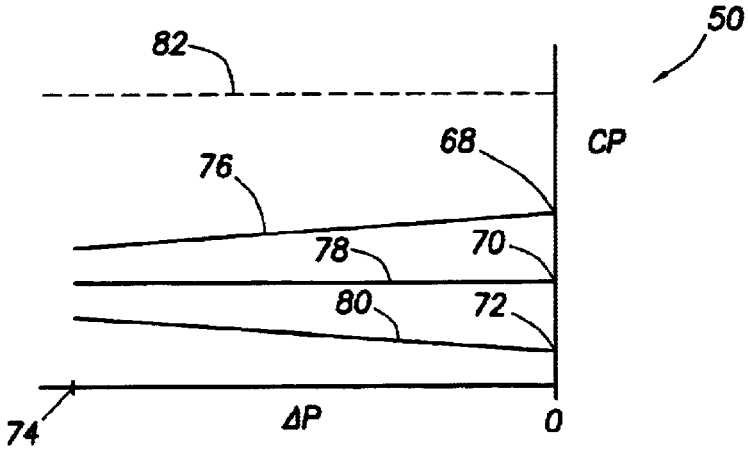
FIG. 5 is a plot of contact pressure vs. differential pressure for the metal to metal seal of FIG. 4.
Figure 6:
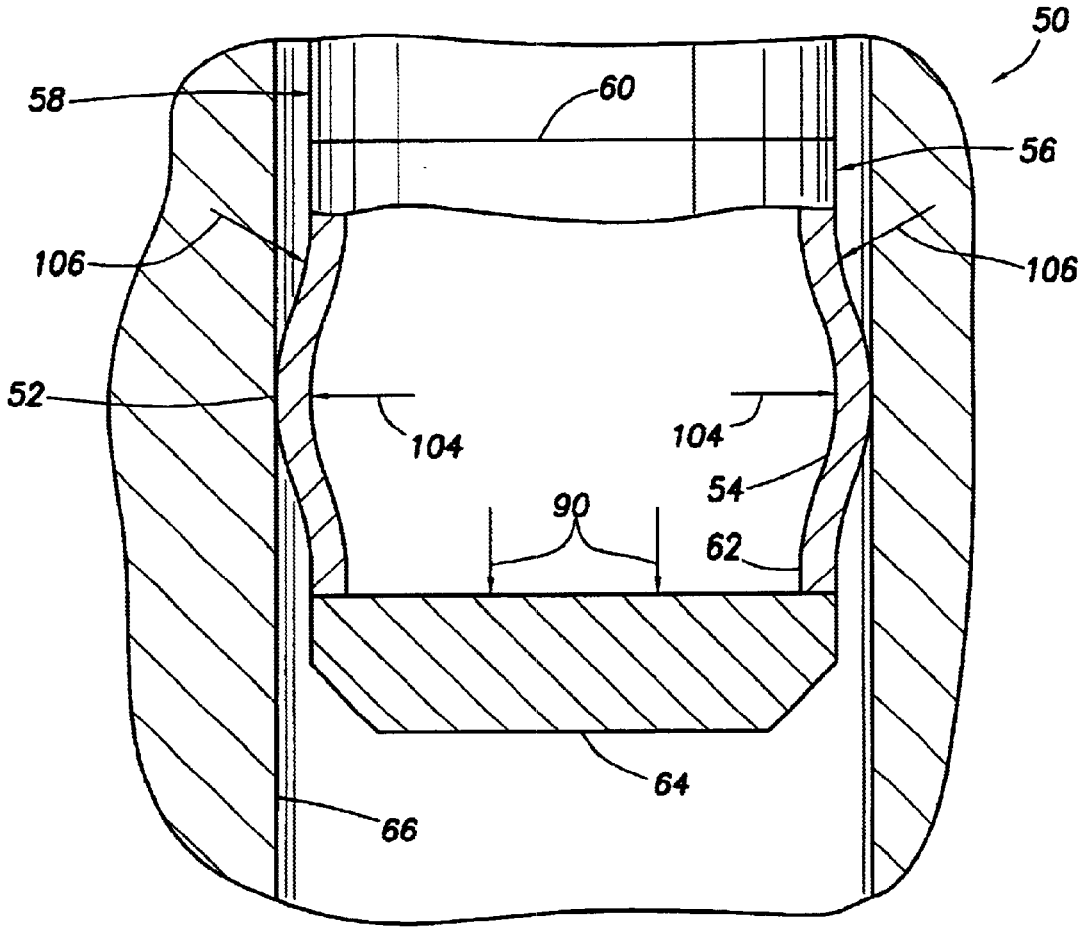
FIG. 6 is a cross-sectional view of the first metal to metal seal, a pressure differential from above being applied to the seal.
Figure 7:
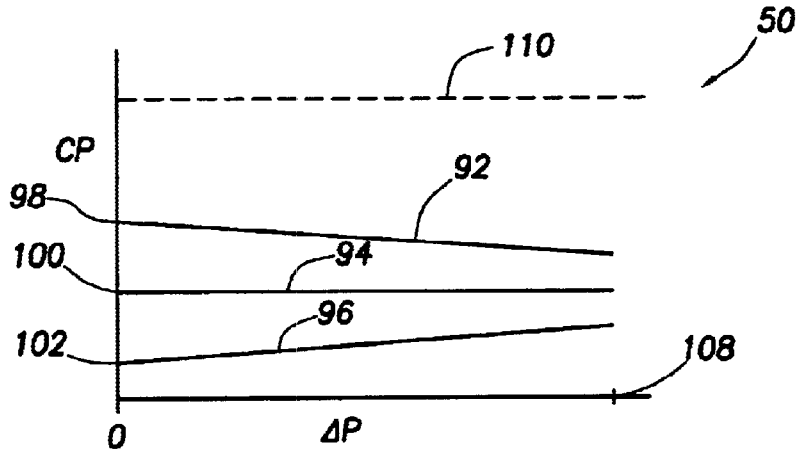
FIG. 7 is a plot of contact pressure vs. differential pressure for the metal to metal seal of FIG. 6.

Turning now to FIGS. 4–7, a plugging system 50 embodying principles of the present invention is representatively illustrated. In FIG. 4, the system 50 is illustrated with a pressure differential applied from below a seal 52. FIG. 5 depicts a plot of differential pressure vs. contact pressure for the system 50 with the pressure differential being applied from below (as in FIG. 4). In FIG. 6, the system 50 is illustrated with the pressure differential applied from above the seal 52. FIG. 7 depicts a plot of differential pressure vs. contact pressure for the system 50 with the pressure differential being applied from above (as in FIG. 6).

The system 50 includes the seal 52 disposed on a circumferentially continuous portion 54 of a substantially hollow structure 56 attached to an anchoring device 58. The hollow structure 54 has opposite axial ends 60, 62. The upper end 60 is open, so that pressure above the seal 52 is admitted into the interior of the structure 54. The lower end 62 is closed off by a piston 64 which prevents pressure transmission therethrough.

The seal 52 is received in a seal bore 66. The anchoring device 58 secures the upper end 60 of the structure portion 54 against displacement relative to the bore 66, thereby maintaining the seal 52 within the bore. The anchoring device 58 maybe of any type, for example, the type well known to those skilled in the art which includes outwardly extendable lugs or keys for engagement with a profile, the type well known to those skilled in the art which includes one or more slips or other gripping members for gripping the bore 66, etc.

An interference fit exists between the seal 52 and the bore 66 with no pressure differential across the seal, and so an initial contact pressure exists between the seal and the bore. Examples of such initial contact pressures are indicated as points 68, 70, 72 in FIG. 5. Although point 68 is depicted as indicating a higher contact pressure than point 70, which is depicted as indicating a higher contact pressure than point 72, it is to be understood that these are merely representative examples of initial contact pressures, and the initial contact pressure between the seal 52 and the bore 66 may be any value.

For example, a typical application with common materials used for metal to metal sealing may require that the contact pressure between the seal 52 and the bore 66 be maintained at least 20,000 psi greater than the differential pressure across the seal. In that case, the contact pressure indicated by each of the points 68, 70, 72 would be at least 20,000 psi at zero differential pressure. At a maximum differential pressure rating from below, as indicated on the horizontal axis by point 74 in FIG. 5, plots 76, 78, 80 (each representing contact pressure vs. differential pressure for one of the specific examples) would indicate contact pressures at least 20,000 psi greater than the maximum required differential pressure.

Of course, the example plots 76, 78, 80 also preferably remain below a maximum desired contact pressure indicated by horizontal dashed line 82 in FIG. 5. For example, if the yield strength of each of the seal 52 and bore 66 materials is 120,000 psi, the maximum desired contact pressure 82 may be 80% of the yield strength, or 96,000 psi, to ensure that neither the seal nor the bore is damaged by the contact pressure. Thus, the example plots 76, 78, 80 remain below the maximum desired contact pressure 82 from zero differential pressure to the maximum required differential pressure 74.

Referring specifically now to FIG. 4, the manner in which the contact pressure for the plug system 50 may be regulated to produce any of the example plots 76, 78, 80 will now be described. When differential pressure is applied to the structure 56 from below (indicated by arrows 84 in FIG. 4, and the horizontal axis to the left of the vertical axis in FIG. 5), this differential pressure is resisted by the piston 64, which is biased upward. This is due to the fact that the pressure on the interior of the structure 56 is less than the pressure on the exterior of the structure below the seal 52.

Since the piston 64 is attached to the lower end 62 of the portion 54, the lower end is also biased upward, and a compressive axial stress is thereby induced in the portion 54. The lower end 62 may actually displace upward relative to the upper end 60 due to the pressure differential 84 acting on the piston 64.

The portion 54 has an outwardly convex shape, similar to a bellows, and so when an axial compressive stress is induced in the portion it is biased outward. This outward biasing is indicated by arrows 86 in FIG. 4. It will be readily appreciated that such outward biasing will tend to increase the contact pressure between the seal 52 and the bore 66 with increased pressure differential from below, as indicated by example 80 in FIG. 5.

However, a section of the portion 54 below the seal 52 also experiences the pressure differential, and is biased inwardly as indicated by arrows 88 in FIG. 4. It will be readily appreciated that such inward biasing will tend to reduce the contact pressure between the seal 52 and the bore 66 with increased pressure differential from below, as indicated by example 76 in FIG. 5. In particular, the inward biasing 88 induces compressive circumferential stress (also known as compressive hoop stress) in the portion 54 below the seal 52, tending to radially inwardly retract the seal.

Another factor which influences the change in contact pressure due to a change in pressure differential is the rigidity of the piston 64. Since the piston 64 is attached to the lower end 62, the rigidity of the piston may be used to outwardly support the section of the portion 54 below the seal 52, thereby resisting the inward biasing indicated by the arrows 88.

As depicted in FIG. 4, the piston 64 is substantially thicker than the portion 54 and so, if the piston and portion 54 are made of the same material, the piston is substantially more rigid than the portion. However, this is not necessarily the case. The piston 64 could be more rigid than the portion 54 without being thicker than the portion 54. The piston 64 could also be less rigid than the portion 54 if desired. Furthermore, the piston 64 could be made of a different material than the portion 54.

For example, in a particular application, it may be desirable to enhance the inward biasing indicated by arrows 88, to thereby limit or reduce the contact pressure between the seal 52 and bore 66. In that case, the rigidity of the piston 64 could be reduced so that the lower end 62 could deflect radially inward under the influence of the inward biasing 88.

To increase the effect on the contact pressure of the outward biasing 86 of the portion 54 due to compressive axial stress therein, the portion could be made so that it has a more outwardly convex shape, or it could be made less rigid, etc. To increase the effect on the contact pressure of the inward biasing 88 of the portion 54 due to the pressure differential below the seal 52, the section below the seal could be made longer, or it could be made less rigid, etc.

Therefore, it will be readily appreciated by one skilled in the art that the effects of the inward biasing 88 and outward biasing 86 on the contact pressure between the seal 52 and the bore 66 may be balanced or otherwise manipulated by changing the shapes and materials of which the piston 64 and portion 54 are made. The contact pressure can be made to decrease with increased differential pressure from below, as indicated by the example plot 76 in FIG. 5, by enhancing the influence of the inward biasing 88. The contact pressure can be made to increase with increased differential pressure from below, as indicated by the example plot 80 in FIG. 5, by enhancing the influence of the outward biasing 86. The contact pressure can be made to remain substantially constant with increased differential pressure from below, as indicated by the example plot 78 in FIG. 5, by balancing the influences of the inward 88 and outward 86 biasing on the portion 54.

This is a significant advance over prior sealing methods in which contact pressure necessarily increases with increased differential pressure across the seal in the sealing direction. Compare the example plots 76, 78, 80 of FIG. 5 with the line 42 of FIG. 3. Note that, with the system 50 provided by the present invention, any desired slope of contact pressure vs. differential pressure may be obtained, including negative slope and no slope.

It may be desirable in some applications to have a relatively high initial contact pressure, but to maintain the contact pressure below a yield stress of the seal material at a relatively high differential pressure. The system 50 enables such a seal to be obtained by regulating how the contact pressure changes due to increased differential pressure. Prior art systems do not have this flexibility of design.

Turning now to FIGS. 6 & 7, the system 50 is depicted with a pressure differential applied from above. This pressure differential is indicated by arrows 90 in FIG. 6, and by the horizontal axis to the right of the vertical axis in FIG. 7. Since the upper end 60 of the structure 56 is open, the pressure from above is permitted to enter the interior of the structure. An initial contact pressure between the seal 52 and the bore 66 is indicated for three example plots 92, 94, 96 by points 98, 100, 102 in FIG. 7. The manner in which the contact pressure is regulated for differential pressure from above 90 is described below.

The piston 64 is biased downwardly by the differential pressure 90. This downward biasing induces an axial tensile stress in the portion 54, which inwardly biases the seal 52 due to the outwardly convex shape of the portion. Stated differently, the axial stress tends to elongate the portion 54, thereby radially inwardly retracting the seal 52. The lower end 62 may actually displace downwardly relative to the upper end 60 due to the pressure differential 90 acting on the piston 64.

However, the differential pressure 90 also acts on the portion 54, at least below the seal 52, which tends to outwardly bias the seal as indicated by arrows 104 in FIG. 6. This outward biasing 104 acts to increase the contact pressure between the seal 52 and the bore 66. The outward biasing 104 is due to tensile circumferential stress (also known as tensile hoop stress) in the portion 54.

Note that the section of the portion 54 above the seal 52 is depicted in FIG. 6 as also having the pressure applied thereto, as indicated by arrows 106. Thus, in this embodiment of the system 50, the portion 54 above the seal 52 is pressure balanced and is not biased inwardly or outwardly by the pressure applied directly thereto. In other embodiments described below, the portion above the seal may not be pressure balanced.

The rigidity of the piston 64 also influences the manner in which the contact pressure changes with increased differential pressure from above. For example, if the piston 64 has relatively high rigidity, as depicted in FIG. 6, it will resist outward biasing 104 of the portion 54, thereby limiting or reducing any increase in contact pressure due to the pressure differential. However, if the piston 64 has a relatively low rigidity the axial tensile stress applied to the portion 54 may be reduced, thereby increasing the contact pressure.

As with the examples discussed above for pressure differential applied from below illustrated in FIGS. 4 & 5, the contact pressure between the seal 52 and the bore 66 may be regulated by manipulating the shapes and materials of which the piston 64 and portion 54 are made. For example, the contact pressure can be made to decrease with increased differential pressure, as indicated by the example plot 92 in FIG. 7, by enhancing the influence of the inward biasing due to axial tensile stress in the portion 54. The contact pressure can be made to increase with increased differential pressure, as indicated by the example plot 96 in FIG. 7, by enhancing the influence of the outward biasing 104. The contact pressure can be made to remain substantially constant with increased differential pressure, as indicated by example plot 94 in FIG. 7, by balancing the inward and outward biasing of the portion 54.

Again, a significant advantage afforded by the invention is that the contact pressure may be regulated so that, for example, the contact pressure remains high enough to seal at a maximum required pressure rating (indicated by point 108 on the horizontal axis in FIG. 7), but remains below a desired maximum contact pressure (indicated by horizontal dashed line 110 in FIG. 7). The slope of the contact pressure vs. differential pressure for a particular application can be made positive (as in example plot 96), negative (as in example plot 92), or even zero (as in example plot 94).

Due to the fact that contact pressure may be regulated in the system 50, it is not necessary for very tight tolerances to be utilized in preparation of the seal 52 and bore 66. For example, the portion 54 may be made relatively flexible, so that relatively large interference fits between the seal 52 and bore 66 may be accommodated without damage to either. An interference of 0.006 in. could be used, with a tolerance of 0.001 in., for example. The ability to control how contact pressure varies with differential pressure thus enables more economical manufacture of plugging systems.

Referring additionally now to FIG. 8, another embodiment of a plugging system 114 embodying principles of the present invention is representatively illustrated. In the system 114, an anchoring device 116 is attached to an upper end 118 of a hollow structure 120, thereby securing it relative to a bore 122. Another end 124 of the structure 120 is closed to prevent pressure transmission therethrough.

A seal 126 is formed on a portion 128 of the structure 120 between the opposite ends 118, 124. The seal 126 is received within a seal bore 130 and is an interference fit therein. Thus, an initial contact pressure between the seal 126 and bore 130 results from installation of the seal in the bore.

The seal 126 is formed directly on the portion 128 and is preferably made of metal, as is the remainder of the hollow structure 120. In fact, the hollow structure 120 is preferably a single integrally formed member which has a substantially spherical shape, the seal 126 being disposed on an outer surface of the circumferentially continuous portion 128 between the ends 118, 124. This integral formation of the structure 120 provides for economical manufacture and other benefits, but it is to be understood that the structure may be otherwise configured, without departing from the principles of the invention.

Note that the end 124 has a somewhat greater thickness than the portion 128. This provides additional rigidity to the end 124, which operates in a manner similar to the piston 64 of the system 50 described above. The end 124 does, however, have a spherical shape and, thus, does not provide the degree of resistance to deflection of the portion 128 as the piston 64 does for the portion 54 of the system 50.

Contact pressure between the seal 126 and the bore 130 may be regulated in a manner similar to that described above for regulation of contact pressure between the seal 52 and bore 66. Specifically, the lower piston end 124 may be made more or less rigid, or may be otherwise shaped, the portion 128 may be made more or less rigid, or may be otherwise shaped, the portion 128 may be lengthened or shortened above or below the seal 126, etc.

Note that an optional additional seal 132 is carried on the structure 120 proximate the upper end 118. The seal 132 is sealed within the bore 122 and acts to isolate the section of the portion 128 above the seal 126 from pressure applied from above. Thus, the seal 132 presents another means by which the change in contact pressure due to differential pressure may be regulated.

Figure 9:
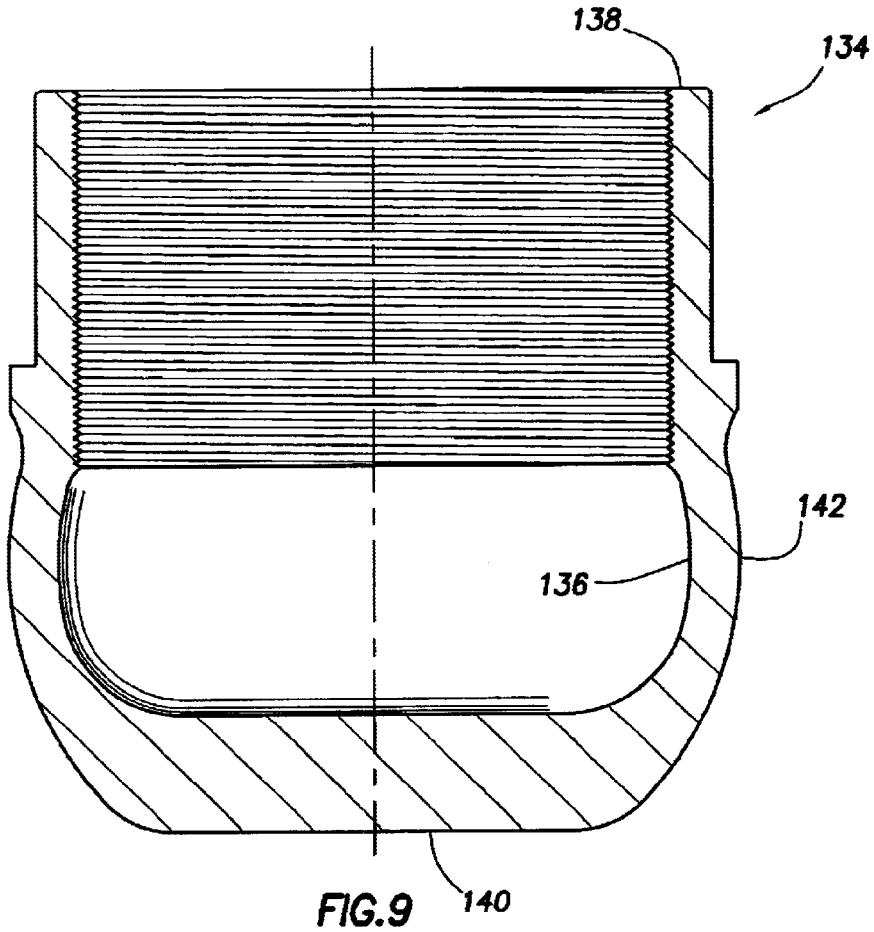
FIG. 9 is a cross-sectional view of a third metal to metal seal embodying principles of the present invention.

Referring additionally now to FIG. 9, another structure 134 which may be used in well plugging applications is representatively illustrated. The structure 134 may be used in place of the structure 120 of the system 114 shown in FIG. 8, or it may be used in place of the structure 56 of the system 50 shown in FIG. 4. The structure 134 is similar in many respects to the structure 120, in that it includes a substantially spherical circumferentially continuous portion 136 between an open upper end 138 and a closed lower end 140.

However, the lower end 140 is substantially planar, instead of being spherical in shape. The end 140 has a relatively high rigidity as compared to the portion 136 and acts as a piston, inducing axially compressive and tensile stresses in the portion 136 in response to differential pressures applied from below and above, respectively.

In addition to the shape of the lower piston end 140, various other aspects of the structure 134 have been manipulated in design studies performed by the present inventors to produce desirable contact pressures between a seal 142 formed on the portion 136 and a bore in which the seal is to be installed. The result of these manipulations may be seen in FIG. 10, which demonstrates how effectively the principles of the present invention may be applied to regulate contact pressures.

Figure 10:
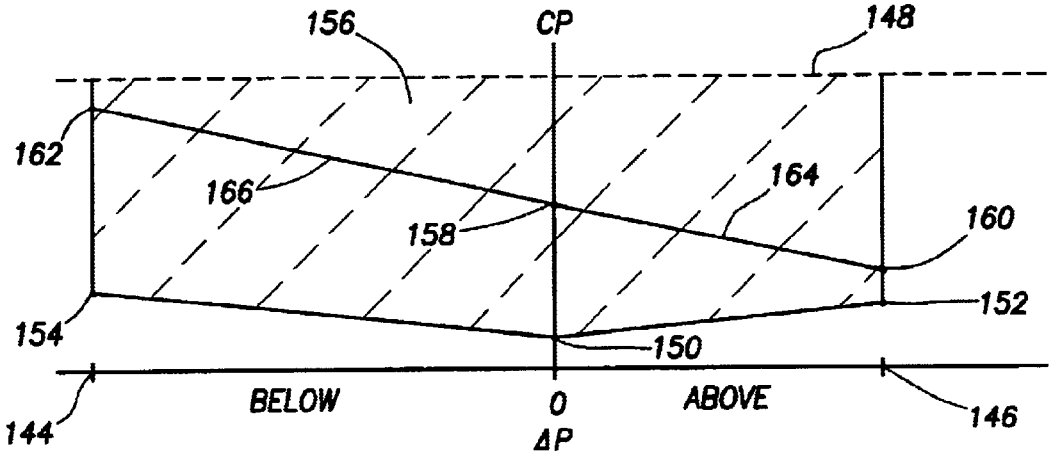
FIG. 10 is a plot of contact pressure vs. differential pressure for the metal to metal seal of FIG. 9.

The inventors designed the structure 134 according to analyses performed for a particular application, and the results depicted in FIG. 10 are given here as only an example of the benefits provided by the invention. Of course, other applications and other designs may be used, without departing from the principles of the present invention. In particular, more than one design may be acceptable for a particular application, a particular design may be used in multiple applications, and different designs may be used in different applications.

For the particular application represented in FIG. 10, a maximum differential pressure rating from below of 22,500 psi (indicated by point 144 on the horizontal axis), and a maximum pressure differential rating from above of 15,000 psi (indicated by point 146 on the horizontal axis) was desired. A maximum desired contact pressure of 108,000 psi (indicated by dashed horizontal line 148) was desired.

In addition, a contact pressure of 20,000 psi greater than the pressure differential was desired to ensure sealing contact between the seal and bore. Thus, at zero differential pressure, a minimum initial contact pressure of 20,000 psi is indicated by point 150 in FIG. 10. At the maximum differential pressure from above 146 (15,000 psi), a contact pressure of 35,000 is indicated by point 152. At the maximum differential pressure from below 144 (22,500 psi), a contact pressure of 42,500 psi is indicated by point 154.

These requirements established an acceptable range of contact pressures indicated in FIG. 10 by the shaded region 156. The inventors then manipulated the design of the structure 134 until the resulting contact pressures in the specified range of differential pressures fell between the maximum and minimum desired levels.

At zero differential pressure, an initial contact pressure of approximately 78,000 psi is indicated by point 158. At the maximum differential pressure from above 146, a contact pressure of approximately 36,600 psi is indicated by point 160. At the maximum differential pressure from below 144, a contact pressure of approximately 98,700 psi is indicated by point 162.

Although a plot 164 of contact pressure vs. differential pressure between the points 158 and 160 is shown as being linear in FIG. 10, it will be readily appreciated that in actual practice the plot 164 may be other than substantially linear. Similarly, although a plot 166 of contact pressure vs. differential pressure between the points 158 and 162 is shown as being linear in FIG. 10, it will be readily appreciated that in actual practice the plot 166 may be other than substantially linear. For example, these plots 164, 166 may have a curvature, may be made up of multiple line segments, etc.

For the structure 134, the plot 164 has a slope of approximately −2.4. That is, the ratio of contact pressure decrease to differential pressure increase from above is approximately 2.4 to 1. The plot 166 has a slope of approximately −0.9. That is, the ratio of contact pressure increase to differential pressure increase from below is approximately 0.9 to 1.

Thus has been described the plugging systems 50, 114 and plug structures 56, 120, 134 which enable contact pressures to be effectively regulated as desired, and which are economical in manufacture and operation. Although each of the structures 56, 120, 134 has been described as having a metal seal thereon, it will be readily appreciated that other seal materials could be used. In fact, any portion of the structures 56, 120, 134 may be made of any material, without departing from the principles of the invention.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. For example, although the structures 56, 120, 134 are described above as being hollow, they could instead merely have voids therein for admitting pressure into the interiors of the structures. Accordingly, the foregoing detailed description is to be clearly understood as being given by way of illustration and example only, the spirit and scope of the present invention being limited solely by the appended claims and their equivalents.

What is claimed is:

1. A plugging system, comprising:

a metal seal circumferentially contacting a radially inwardly facing surface of a bore having a longitudinal axis; and a piston attached to the seal, the piston biasing the seal in a direction of a pressure differential across the piston relative to the bore.

2. The plugging system according to claim 1, wherein an increase in the pressure differential acting on the piston acts to reduce a contact pressure between the seal and the bore.

3. A plugging system, comprising:

a metal seal circumferentially contacting a bore having a longitudinal axis; and a piston attached to the seal, the piston biasing the seal in a direction of a pressure differential across the piston relative to the bore, wherein an increase in the pressure differential acting on the piston acts to reduce a contact pressure between the seal and the bore, and wherein the contact pressure reduction relative to pressure differential increase is at a ratio of less than 3 to 1.

4. The plugging system according to claim 1, wherein an increase in the pressure differential acting on the piston acts to increase a contact pressure between the seal and the bore.

5. A plugging system, comprising:

a metal seal circumferentially contacting a bore having a longitudinal axis; and a piston attached to the seal, the piston biasing the seal in a direction of a pressure differential across the piston relative to the bore, wherein an increase in the pressure differential acting on the piston acts to increase a contact pressure between the seal and the bore, and wherein the contact pressure increase relative to pressure differential increase is at a ratio of less than 2 to 1.

6. The plugging system according to claim 1, wherein the piston biases the seal in a first axial direction relative to the bore when the pressure differential is in the first direction, and wherein the piston biases the seal in a second axial direction opposite to the first direction when the pressure differential is in the second direction.

7. The plugging system according to claim 6, wherein the pressure differential acting on the piston in the first direction acts to increase a contact pressure between the seal and the bore, and wherein the pressure differential acting on the piston in the second direction acts to reduce the contact pressure between the seal and the bore.

8. A plugging system, comprising:

a metal seal circumferentially contacting a bore having a longitudinal axis; and a piston attached to the seal, the piston biasing the seal in a direction of a pressure differential across the piston relative to the bore, wherein the seal and piston are integrally formed as a single member extending laterally across the bore.

9. The plugging system according to claim 1, wherein the seal is disposed on an axially elongated and circumferentially continuous portion of a hollow structure having first and second opposite axial ends, the seal being disposed between the first and second ends.

10. The plugging system according to claim 9, wherein the piston is a closed one of the ends.

11. A plugging system, comprising:

a metal seal circumferentially contacting a bore having a longitudinal axis; and a piston attached to the seal, the piston biasing the seal in a direction of a pressure differential across the piston relative to the bore, wherein the seal is disposed on an axially elongated and circumferentially continuous portion of a hollow structure having first and second opposite axial ends, the seal being disposed between the first and second ends, and wherein the hollow structure includes an opening for admitting pressure from an exterior into an interior of the hollow structure.

12. The plugging system according to claim 11, wherein the opening is formed through the hollow structure on a first axial side of the seal relative to the bore, and wherein the hollow structure is closed on an opposite second axial side of the seal relative to the bore, so that the pressure differential acts on the hollow structure on the second axial side of the seal.

13. The plugging system according to claim 12, wherein the pressure differential acts on the hollow structure only on the second axial side of the seal, the hollow structure on the first axial side of the seal being pressure balanced.

14. The plugging system according to claim 12, wherein the pressure differential acts on the hollow structure on the first axial side of the seal.

15. A plugging system, comprising:

a metal seal circumferentially contacting a bore having a longitudinal axis; and a piston attached to the seal, the piston biasing the seal in a direction of a pressure differential across the piston relative to the bore, wherein the seal is disposed on an axially elongated and circumferentially continuous portion of a hollow structure having first and second opposite axial ends, the seal being disposed between the first and second ends, and wherein the first end has an opening formed therethrough which admits pressure into an interior of the hollow structure, and wherein the second end is closed to pressure transmission therethrough.

16. The plugging system according to claim 15, wherein the second end is substantially more rigid than the portion between the first and second ends.

17. The plugging system according to claim 16, wherein an increase in the second end rigidity acts to reduce a radially inward biasing of the seal due to the pressure differential across the piston.

18. The plugging system according to claim 16, wherein the second end has a substantially greater thickness than the portion between the first and second ends.

19. The plugging system according to claim 15, wherein the second end is the piston.

20. A plugging system, comprising:

a metal seal circumferentially contacting a bore having a longitudinal axis; and a piston attached to the seal, the piston biasing the seal in a direction of a pressure differential across the piston relative to the bore, wherein the seal is disposed on an axially elongated and circumferentially continuous portion of a hollow structure having first and second opposite axial ends, the seal being disposed between the first and second ends, and wherein the second end displaces relative to the first end in response to the pressure differential.

21. The plugging system according to claim 20, wherein displacement of the second end relative to the first end alters a contact pressure between the seal and the bore.

22. The plugging system according to claim 20, wherein displacement of the second end toward the first end axially compresses the hollow structure portion between the first and second ends, thereby biasing the seal radially outward.

23. The plugging system according to claim 20, wherein displacement of the second end away from the first end axially elongates the hollow structure portion between the first and second ends, thereby biasing the seal radially inward.

24. A plugging system, comprising:

a metal seal circumferentially contacting a bore having a longitudinal axis; and a piston attached to the seal, the piston biasing the seal in a direction of a pressure differential across the piston relative to the bore, wherein the pressure differential across the piston in a first axial direction elongates the seal, and wherein the pressure differential across the piston in a second axial direction opposite to the first direction compresses the seal.

25. The plugging system according to claim 1, A plugging system, comprising:

a metal seal circumferentially contacting a bore having a longitudinal axis; and a piston attached to the seal, the piston biasing the seal in a direction of a pressure differential across the piston relative to the bore, wherein a contact pressure between the seal and the bore remains substantially constant when the direction of the pressure differential is reversed.

26. A plugging system, comprising:

a metal seal circumferentially contacting a bore having a longitudinal axis; and a piston attached to the seal, the piston biasing the seal in a direction of a pressure differential across the piston relative to the bore, wherein a contact pressure between the seal and the bore remains substantially constant when the pressure differential is increased in a first axial direction relative to the bore, and wherein the contact pressure remains substantially constant when the pressure differential is increased in a second axial direction opposite to the first axial direction relative to the bore.

27. A plugging system, comprising:

a metal seal circumferentially contacting a bore having a longitudinal axis; and a piston attached to the seal, the piston biasing the seal in a direction of a pressure differential across the piston relative to the bore, wherein a contact pressure between the seal and the bore increases when the pressure differential is increased in a first axial direction relative to the bore, and wherein the contact pressure increases when the pressure differential is increased in a second axial direction opposite to the first axial direction relative to the bore.

28. A plugging system, comprising:

a metal seal circumferentially contacting a bore having a longitudinal axis; and a piston attached to the seal, the piston biasing the seal in a direction of a pressure differential across the piston relative to the bore wherein a contact pressure between the seal and the bore does not decrease substantially when the pressure differential is increased in a first axial direction relative to the bore, and wherein the contact pressure does not decrease substantially when the pressure differential is increased in a second axial direction opposite to the first axial direction relative to the bore.

29. A method of plugging a bore, the method comprising the steps of:

positioning a hollow structure within the bore, the hollow structure having a seal on a circumferentially continuous portion disposed between opposite first and second ends of the structure;

sealingly engaging the seal with the bore, thereby preventing fluid flow through the bore;

securing the first structure end relative to the bore; and applying axial tensile stress to the structure portion between the first and second ends in response to a pressure differential across the second structure end in a first axial direction relative to the bore, thereby biasing the seal radially inward.

30. The method according to claim 29, wherein in the positioning step, the first opposite end has an opening therein to admit pressure into an interior of the structure, and the second opposite end is closed to pressure transmission therethrough.

31. The method according to claim 29, wherein the applying step further comprises reducing a contact pressure between the seal and the bore in response to an increase in the pressure differential in the first direction.

32. The method according to claim 29, wherein the applying step further comprises increasing a contact pressure between the seal and the bore in response to an increase in the pressure differential in the first direction.

33. The method according to claim 29, wherein in the applying step, a contact pressure between the seal and the bore remains substantially constant in response to an increase in the pressure differential in the first direction.

34. The method according to claim 29, further comprising the step of applying compressive stress to the structure portion between the first and second ends in response to a pressure differential across the second structure end in a second axial direction relative to the bore, thereby biasing the seal radially outward.

35. The method according to claim 34, wherein the compressive stress applying step further comprises reducing a contact pressure between the seal and the bore in response to an increase in the pressure differential in the second direction.

36. The method according to claim 34, wherein the compressive stress applying step further comprises increasing a contact pressure between the seal and the bore in response to an increase in the pressure differential in the second direction.

37. The method according to claim 34, wherein in the compressive stress applying step, a contact pressure between the seal and the bore remains substantially constant in response to an increase in the pressure differential in the second direction.

38. The method according to claim 29, wherein the applying step further comprises applying circumferential tensile stress to the structure portion between the first and second ends in response to the pressure differential in the first direction, thereby biasing the seal radially outward.

39. The method according to claim 38, further comprising the step of balancing the radially inward and radially outward biasing applied to the seal, thereby regulating a contact pressure between the seal and the bore in response to the pressure differential in the first direction.

40. A method of plugging a bore, the method comprising the steps of:

positioning a hollow structure within the bore, the hollow structure having a seal on a circumferentially continuous portion disposed between opposite first and second ends of the structure;

sealingly engaging the seal with the bore, thereby preventing fluid flow through the bore;

securing the first structure end relative to the bore; and applying axial compressive stress to the structure portion between the first and second ends in response to a pressure differential across the second structure end in a first axial direction relative to the bore, thereby biasing the seal radially outward, the sealingly engaging step being performed prior to the compressive stress applying step.

41. The method according to claim 40, wherein in the positioning step, the first opposite end has an opening therein to admit pressure into an interior of the structure, and the second opposite end is closed to pressure transmission therethrough.

42. A method of plugging a bore, the method comprising the steps of:

positioning a hollow structure within the bore, the hollow structure having a seal on a circumferentially continuous portion disposed between opposite first and second ends of the structure;

sealingly engaging the seal with the bore, thereby preventing fluid flow through the bore;

securing the first structure end relative to the bore; and applying axial compressive stress to the structure portion between the first and second ends in response to a pressure differential across the second structure end in a first axial direction relative to the bore, thereby biasing the seal radially outward, the applying step further comprising reducing a contact pressure between the seal and the bore in response to an increase in the pressure differential in the first direction.

43. The method according to claim 40, wherein the applying step further comprises increasing a contact pressure between the seal and the bore in response to an increase in the pressure differential in the first direction.

44. A method of plugging a bore, the method comprising the steps of:

positioning a hollow structure within the bore, the hollow structure having a seal on a circumferentially continuous portion disposed between opposite first and second ends of the structure;

sealingly engaging the seal with the bore, thereby preventing fluid flow through the bore;

securing the first structure end relative to the bore; and applying axial compressive stress to the structure portion between the first and second ends in response to a pressure differential across the second structure end in a first axial direction relative to the bore, thereby biasing the seal radially outward, wherein in the applying step, a contact pressure between the seal and the bore remains substantially constant in response to an increase in the pressure differential in the first direction.

45. A method of plugging a bore, the method comprising the steps of:

positioning a hollow structure within the bore, the hollow structure having a seal on a circumferentially continuous portion disposed between opposite first and second ends of the structure;

sealingly engaging the seal with the bore, thereby preventing fluid flow through the bore;

securing the first structure end relative to the bore;

applying axial compressive stress to the structure portion between the first and second ends in response to a pressure differential across the second structure end in a first axial direction relative to the bore, thereby biasing the seal radially outward; and applying tensile stress to the structure portion between the first and second ends in response to a pressure differential across the second structure end in a second axial direction relative to the bore, thereby biasing the seal radially inward.

46. The method according to claim 45, wherein the tensile stress applying step further comprises reducing a contact pressure between the seal and the bore in response to an increase in the pressure differential in the second direction.

47. The method according to claim 45, wherein the tensile stress applying step further comprises increasing a contact pressure between the seal and the bore in response to an increase in the pressure differential in the second direction.

48. The method according to claim 45, wherein in the tensile stress applying step, a contact pressure between the seal and the bore remains substantially constant in response to an increase in the pressure differential in the second direction.

49. A method of plugging a bore, the method comprising the steps of:

positioning a hollow structure within the bore, the hollow structure having a seal on a circumferentially continuous portion disposed between opposite first and second ends of the structure;

sealingly engaging the seal with the bore, thereby preventing fluid flow through the bore;

securing the first structure end relative to the bore; and applying axial compressive stress to the structure portion between the first and second ends in response to a pressure differential across the second structure end in a first axial direction relative to the bore, thereby biasing the seal radially outward, wherein the applying step further comprises applying circumferential compressive stress to the structure portion between the first and second ends in response to the pressure differential in the first direction, thereby biasing the seal radially inward.

50. The method according to claim 49, further comprising the step of balancing the radially inward and radially outward biasing applied to the seal, thereby regulating a contact pressure between the seal and the bore in response to the pressure differential in the first direction.

51. A plug for use in a bore to prevent flow of well fluids therethrough, the plug comprising:

a structure having a void therein, first and second opposite ends, and a circumferentially extending portion outwardly overlying the void between the first and second ends; and a seal disposed on the structure portion between the first and second ends for sealingly engaging the bore, wherein axial tensile stress in the structure portion between the first and second ends biases the seal radially inward when a pressure differential is applied across the structure in a first axial direction relative to the bore, and wherein axial compressive stress in the structure portion between the first and second ends biases the seal radially outward when the pressure differential is applied across the structure in a second axial direction opposite to the first direction.

52. The plug according to claim 51, wherein circumferential tensile stress in the structure portion between the first and second ends biases the seal radially outward when the pressure differential is applied across the structure in the first direction.

53. The plug according to claim 51, wherein circumferential compressive stress in the structure portion between the first and second ends biases the seal radially inward when the pressure differential is applied across the structure in the second direction.

54. The plug according to claim 51, wherein the structure has an opening in the first end permitting pressure transmission between an exterior of the structure and the void.

55. The plug according to claim 54, wherein the second end isolates the void from pressure communication with the exterior of the structure, whereby the pressure differential is resisted by the second end.

56. The plug according to claim 51, wherein the pressure differential is also applied from the void to an exterior of the structure, thereby causing circumferential tensile stress in the structure portion between the first and second ends and biasing the seal radially outward, when the pressure differential is applied across the structure in the first axial direction.

57. The plug according to claim 51, wherein the pressure differential is also applied from an exterior of the structure to the void, thereby causing circumferential compressive stress in the structure portion between the first and second ends and biasing the seal radially inward, when the pressure differential is applied across the structure in the second axial direction.

58. The plug according to claim 51, wherein the structure is substantially hollow.

59. The plug according to claim 51, wherein the structure is substantially spherical.

60. The plug according to claim 51, wherein the structure portion between the first and second ends has the seal integrally formed therewith.

61. The plug according to claim 51, wherein the seal and the structure portion between the first and second ends are formed as a single metal member.

62. The plug according to claim 51, wherein the seal is a metal seal.

63. The plug according to claim 51, wherein the second end is a piston which displaces relative to the first end in response to the pressure differential.

64. The plug according to claim 63, wherein the piston radially supports the structure portion between the first and second ends.

65. The plug according to claim 64, wherein rigidity of the piston acts to limit radially outward extension of the seal when the pressure differential is applied across the structure in the first direction.

66. The plug according to claim 64, wherein rigidity of the piston acts to limit radially inward retraction of the seal when the pressure differential is applied across the structure in the second direction.

* * * * *